United States Patent [19]

Tajima

[11] 4,429,651

[45] Feb. 7, 1984

[54] DEVICE FOR DETECTING ABSENCE OF A THREAD IN A SEWING MACHINE

[75] Inventor: Ikuo Tajima, Nagoya, Japan

[73] Assignee: Tokai Kogyo Mishin Kabushiki Kaisha, Kasugai, Japan

[21] Appl. No.: 173,425

[22] Filed: Jul. 29, 1980

[30] Foreign Application Priority Data

| | | | |
|---|---|---|---|
| Aug. 6, 1979 | [JP] | Japan | 54-100578 |
| Aug. 6, 1979 | [JP] | Japan | 54-100579 |
| Jun. 27, 1980 | [JP] | Japan | 55-88443 |

[51] Int. Cl.[3] ..... D05B 69/36

[52] U.S. Cl. ..... 112/273

[58] Field of Search ..... 112/273, 278; 66/163; 139/353

[56] References Cited

U.S. PATENT DOCUMENTS

| | | | |
|---|---|---|---|
| 3,101,687 | 8/1963 | Zeltwanger | 112/273 |
| 3,732,834 | 5/1973 | Mayer | 112/273 |
| 3,922,981 | 12/1975 | Hughes | 112/273 X |
| 4,078,505 | 3/1978 | Fitton et al. | 112/273 X |

FOREIGN PATENT DOCUMENTS

| | | | |
|---|---|---|---|
| 934843 | 10/1973 | Canada | 112/273 |

*Primary Examiner*—Peter P. Nerbun

*Attorney, Agent, or Firm*—Irvin A. Lavine

[57] ABSTRACT

Disclosed is a device for detecting absence of a needle thread or a bobbin thread in a sewing machine. The device includes at least one piezoelectric element provided between a throat plate and a rotary hook of the sewing machine. The piezoelectric element is adapted for intermittent contact with one of the threads when the thread shifts from the center of the needle hole by engaging with the rotary hook fin, and for signalling its contact with the thread.

7 Claims, 14 Drawing Figures

DEVICE FOR DETECTING ABSENCE OF A THREAD IN A SEWING MACHINE

BACKGROUND OF THE INVENTION

1. Field of the Invention

This invention relates to a device for detecting absence of a thread in a sewing machine. More particularly, the device is particularly suitable for use during high-speed operation of such a sewing machine.

2. Description of the Prior Art

The prior art has proposed, for example, a device for detecting absence of a bobbin thread whereby a breakage or other abnormal condition of the bobbin thread may be detected by a lever which intermittently contacts the bobbin thread which in turn continuously repeats a slacking and tightening motion in cooperation with the cyclic movement of the needle bar. Generally, such a lever cooperates with a limit switch or a proximity switch which may be energized by an increased travel of the lever when the associated bobbin thread is absent. The disadvantage associated with such device is that the bobbin thread is likely to be damaged by the resilient force of a spring which is applied thereto by way of the lever. In order to cope with this difficulty, if the spring force is attenuated, the moving lever will not be able to follow the machine rotation. To the contrary, if the spring force is strengthened, the lever again will not be able to follow the machine except when the machine is in high-speed operation.

It has also heretofore been proposed to employ a device for detecting absence of a bobbin thread without touching the thread, that is, using a photoelectric element which detects the rocking motion of the bobbin thread in a direction perpendicular to the center of the thread hole. The use of such photoelectric element has the disadvantage that there is a considerable loss in its thread detecting function because of the dust inevitably produced and drifting about the needle hole.

SUMMARY OF THE INVENTION

The aim of the present invention is to provide a device enabling this difficulty and similar difficulties to be reduced or overcome. The present invention provides means for detecting absence of a needle thread or a bobbin thread in a sewing machine, which is adapted for intermittent contact with one of the threads, when the thread shifts from the center of the needle hole by engaging with the rotary hook fin of the sewing machine.

DESCRIPTION OF THE PREFERRED EMBODIMENT

Referring now to FIGS. 1 through 4, there is shown an arrangement according to the first embodiment of the invention.

Figure 1:
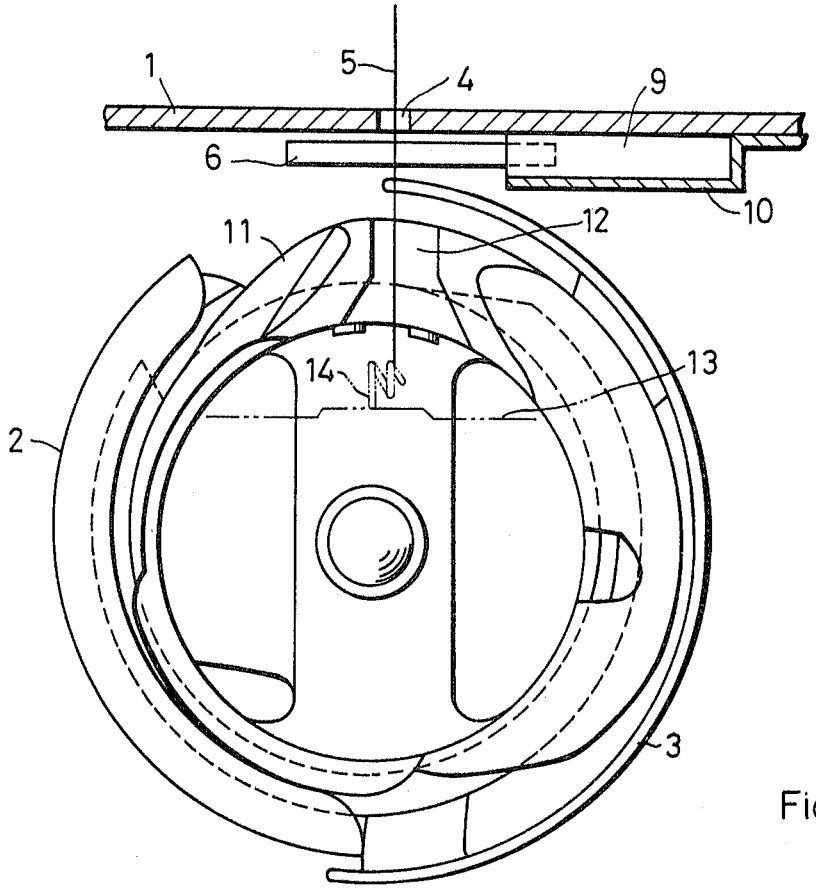
FIG. 1 is an elevational view of the first embodiment according to the present invention.
Figure 2:
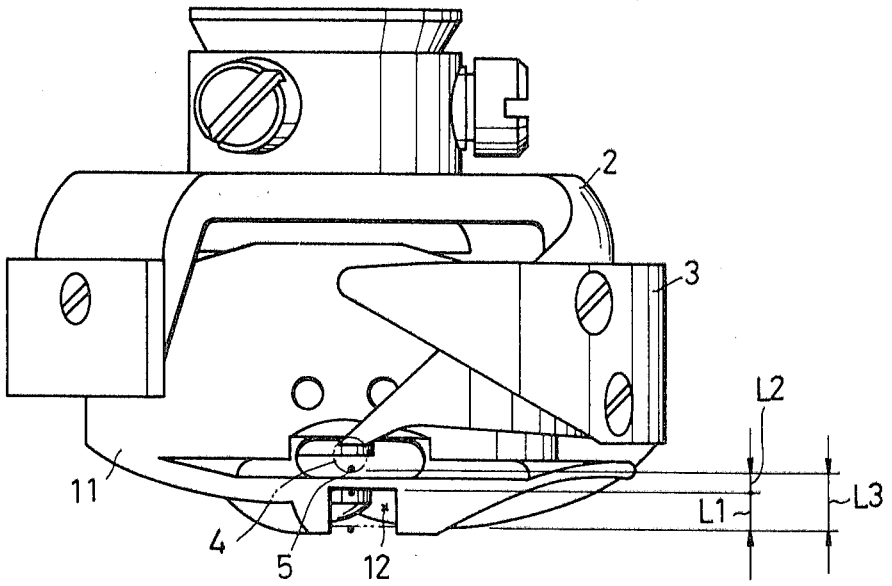
FIG. 2 is a plan view thereof.
Figure 4:
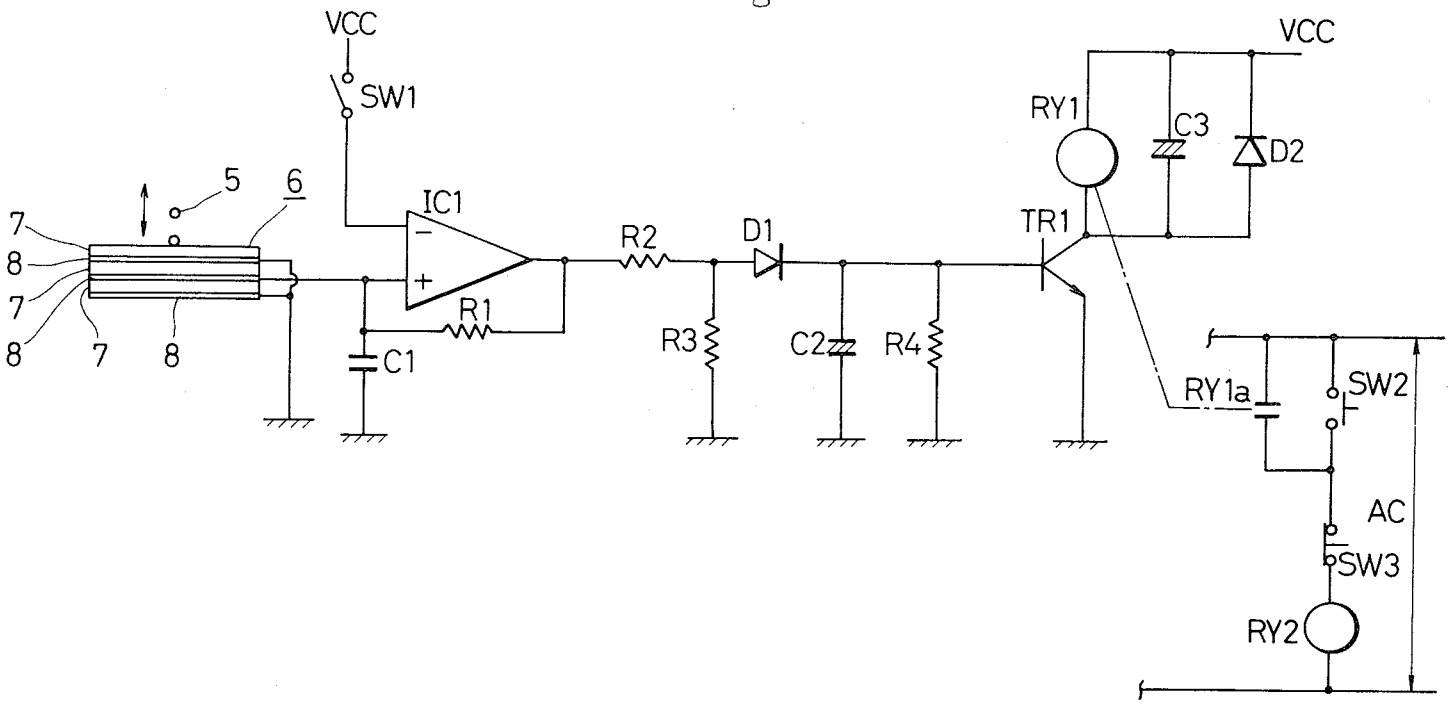
FIG. 4 is a schematic diagram of the electrical circuit thereof.

On the underside of the throat plate 1 of the sewing machine, there is provided a piezoelectric element 6 which intermittently contacts with a bobbin thread 5 when the thread 5 shifts from the center of the needle hole 4 by engaging with the rotary hook fin 3 during the rotation of the rotary hook 2. The piezoelectric element 6 is of a bimorth cell in which a silver electrode 8 is vacuum-deposited to a ceramic body 7 made of lead zirconate-titanate (Ztp). Two pieces of the bimorth cell are connected in parallel, as shown in FIG. 4, and fitted to the underside of the throat plate 1 by way of a soft rubber 9 and a bracket 10. When the rotary hook 2 rotates, the bobbin thread 5 shifts laterally alongside of its normal path in the groove 12 of the case holder 11, as shown in FIG. 2, for distance $L_1$ between the bottom face of the groove 12 and the thread-engaging face of the fin 3, and distance from $L_2$ to $L_3$ with respect to the thread hole 4 of the throat plate 1.

Figure 3:
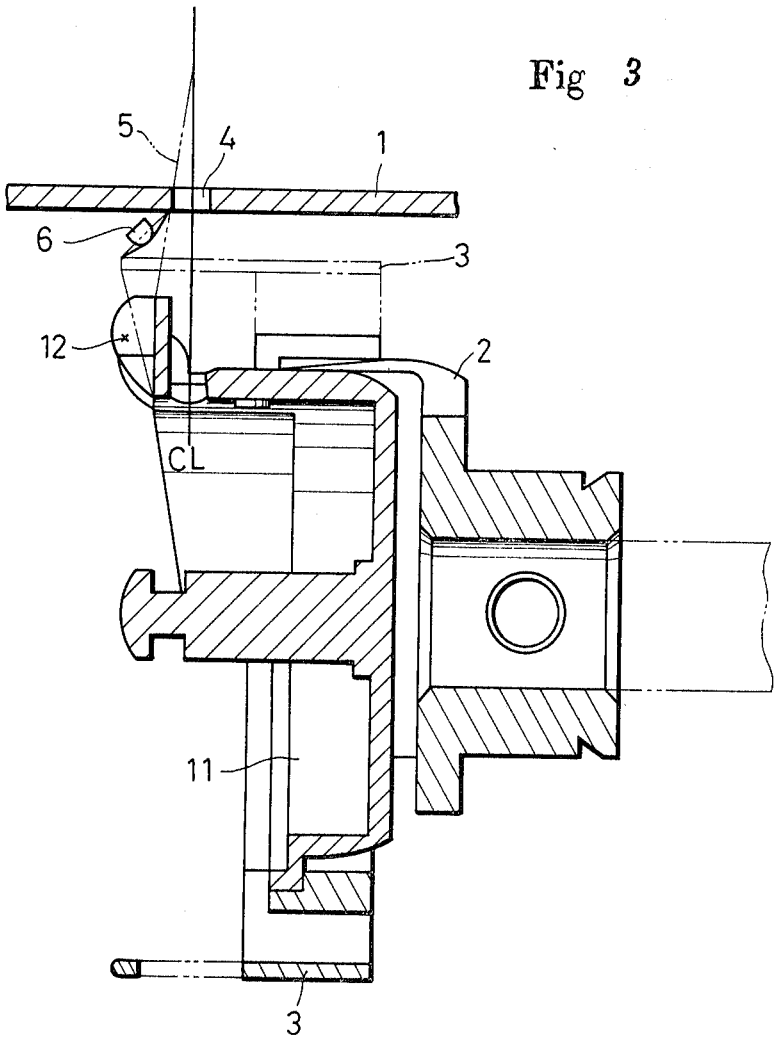
FIG. 3 is a sectional side elevational view thereof.

As a result, each time the rotary hook 2 is rotated, the bobbin thread 5 drawn out from the thread guide 14 of the bobbin 13 is displaced as shown by the long and two short dashes line in FIG. 3, and, the thread 5 contacts with the piezoelectric element 6 during its course of displacement.

Referring now to FIG. 4, which shows an electrical circuit of the embodiment, there are shown switches SW1 to SW3, resistances R1 to R5, diodes D1 and D2, a transistor TR1, relays RY1, and RY2, a normally-open electrical contact **RY1*a* for the relay RY1, and a Schmidt trigger type astable multi-vibrator IC1** (model MC-14093B manufactured by Motorora Inc., U.S.A.) with a gate control, which produces a constant-frequency output when both inputs are high.

Referring to the electrical circuit in FIG. 4, the operation of the embodiment will now be described.

When relay RY2 for starting the sewing machine is energized by turning on switch SW2, with switch SW1 turned on, the needle bar moves up and down, and the rotary hook 2 rotates to thereby cause the bobbin thread 5 to contact with the piezoelectric element 6 each time the thread 5 shifts from the center (CL as shown in FIG. 3) of the thread hole 4. Each time the bobbin thread 5 contacts with the piezoelectric element 6, an output corresponding to the contact is produced therefrom, and, at the same time, a constant-frequency output is generated from the integrated circuit IC1 as the two inputs of the circuit IC1 go high during the period of output corresponding to the contact.

As soon as the sewing macbine begins to operate, therefore, a constant-frequency output is generated from integrated circuit IC1, in a pulse-like manner, corresponding to the intermittent contact of the bobbin thread 5 with the piezoelectric element 6. Transistor TR1 is then energized by the input via diode D1, capacitor C2 and resistance R4 coupled to the same output, to thereby cause relay RY1 and related electrical contact RY1*a* to be energized. The sewing machine continues to remain operative even when the contact RY1*a* is closed.

If the bobbin thread 5 should break during the operation as explained above, transistor TR1 will be deenergized by a low output generated from integrated circuit IC1 due to non-contact of the bobbin thread 5, and, at the same time, relay RY1, relay contact RY1*a* and relay RY2 will be deenergized, thus causing the sewing machine to be brought to an immediate halt.

Figure 5:
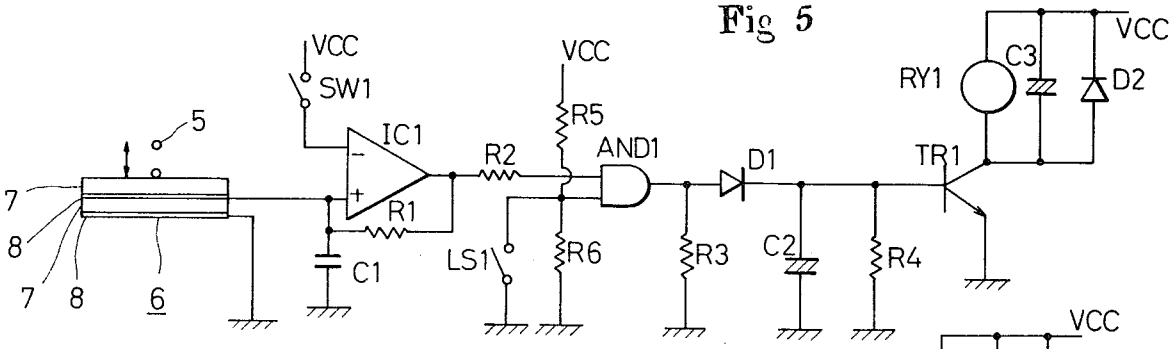
FIG. 5 is a schematic diagram of the electrical circuit of the second embodiment according to the present invention.

FIG. 5 illustrates a second embodiment of the invention, in which the arrangement and operation of the invention are substantially the same as those of the first embodiment except an additional timing action is provided so as to feed a high input to one of the input terminals of AND circuit AND1 via resistances R5 and R6, by activating limit switch LS1 with the aid of a cam attached to the mainshaft for driving the hook shaft which accomplishes one rotation in association with the two rotations of the rotary hook 2, while the needle bar moves up and down each time the rotary hook 2 completes two rotations.

Figure 6:
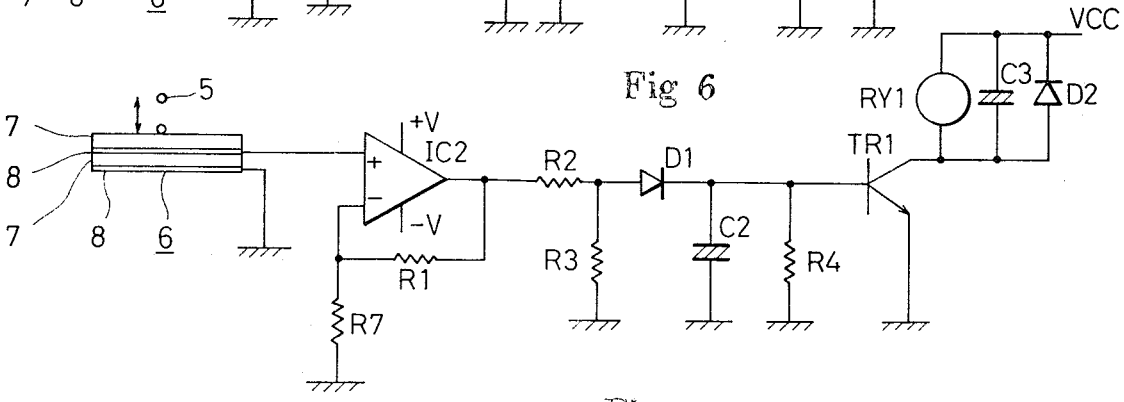
FIG. 6 is a schematic diagram of the electrical current of the third embodiment according to the present invention.

FIG. 6 illustrates a third embodiment of the invention, in which the arrangement and operation of the invention are substantially the same as those of the first embodiment except an integrated circuit IC2 is provided, employing as a voltage comparator a broad-band amplifier with AGC terminal, model MC-1590G, manufactured by Motorora Inc., U.S.A., in place of integrated circuit IC1 as used in the first embodiment.

Figure 7:
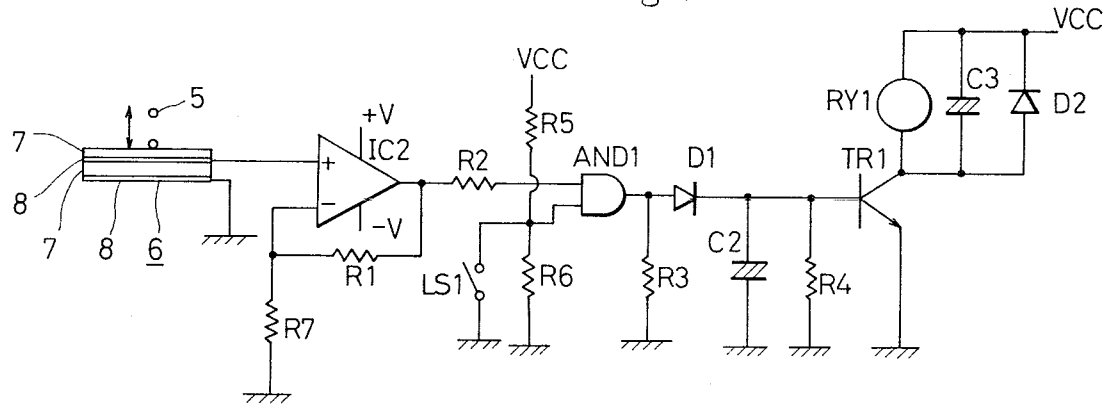
FIG. 7 is a schematic diagram of the electrical circuit of the fourth embodiment according to the present invention.

FIG. 7 illustrates a fourth embodiment of the invention, in which the arrangement and operation of the invention are substantially the same as those of the second embodiment except a timing circuit including an AND circuit AND1, resistances R5 and R6, and a limit switch LS1 are added to the third embodiment.

Figure 8:
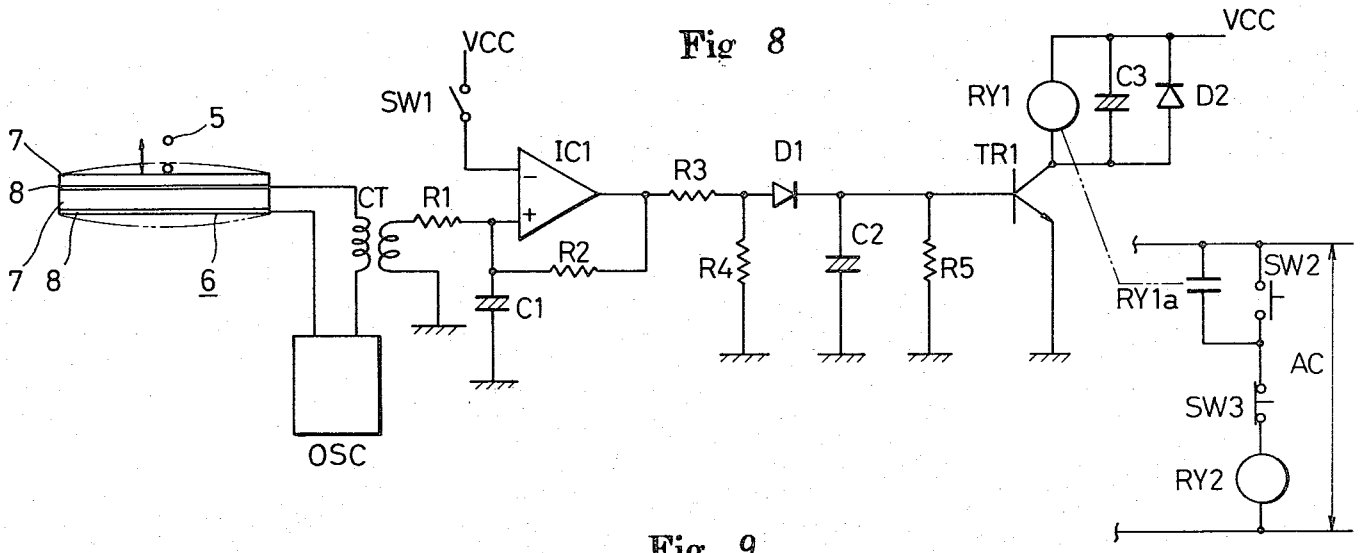
FIG. 8 is a schematic diagram of the electrical circuit of the fifth embodiment according to the present invention.

FIG. 8 illustrates a fifth embodiment of the invention. In this embodiment, a current transformer CT and an oscillator OSC are added to the electrical circuit of the first embodiment. In operation, the piezoelectric element 6, 1.4 mm in width, 0.8 mm in thickness and 12 mm in length, is oscillated by the oscillator, which generates a frequency of 6.4 to 7.0 kc to thereby provide a maximum amplitude at the center lengthwise of the piezoelectric element 6. The impedance change of the piezoelectric element 6 depending on its oscillating and non-oscillating condition is fed to integrated circuit IC1 through current transformer CT. As long as the piezoelectric element 6 is in the oscillating condition, that is, the bobbin thread 5 is in non-contact condition, the impedance of the piezoelectric element 6 is high, and the resultant input to the positive terminal of integrated circuit IC1 through current transformer CT goes low. On the other hand, as long as the piezoelectric element 6 is in the non-oscillating condition where the bobbin thread 5 contacts the piezoelectric element 6, the input to the positive terminal of integrated circuit IC1 goes high in the same manner as described above.

Accordingly, when relay RY2 for starting the sewing machine is energized by turning on switch SW2, with switch SW1 turned on, the sewing machine starts to thereby cause the bobbin thread 5 to contact the piezoelectric element 6, and, from integrated circuit IC1, a constant-frequency output is generated in a pulse-like manner, corresponding to the intermittent contact of the bobbin thread 5 with the piezoelectric element 6. Transistor TR1 is then energized by the input via diode D1, capacitor C2 and resistance R5, to thereby cause relay RY1 and related electrical contact RY1*a* to be energized. The sewing machine continues to remain operative even when switch SW2 is opened while the contact RY1*a* is closed.

If the bobbin thread 5 should break during the operation as explained above, transistor TR1 will be deenergized by a low output generated from integrated contact IC1 due to non-contact of the bobbin thread 5, and, at the same time, relay RY1, relay contact RY1*a* and relay RY2 will be deenergized, thus causing the sewing machine to be brought to an immediate halt.

Figure 9:
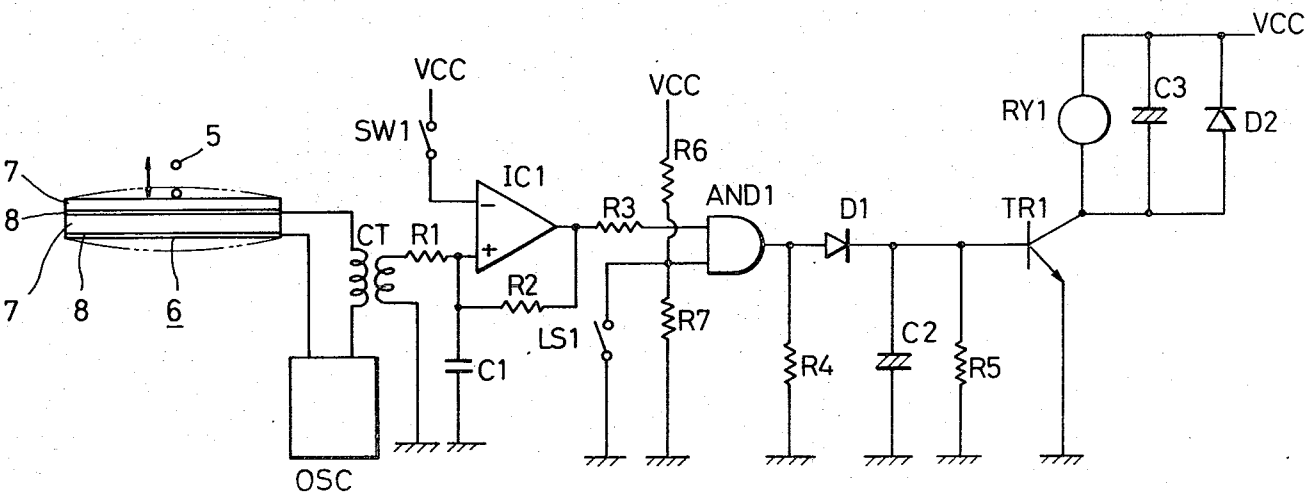
FIG. 9 is a schematic diagram of the electrical circuit of the sixth embodiment according to the present invention.

FIG. 9 illustrates a sixth embodiment of the invention, in which the arrangement and operatin of the invention are substantially the same as those of the fifth embodiment except an additional timing action is provided so as to feed a high input to one of the input terminals of AND circuit AND1 via resistances R6 and R7, by activating limit switch LS1 with the aid of a cam attached to the mainshaft for driving the hook shaft which accomplishes one rotaton in association with the two rotations of the rotary hook 2, while the needle bar moves up and down each time the rotary hook 2 completes two ratations.

Figure 10:
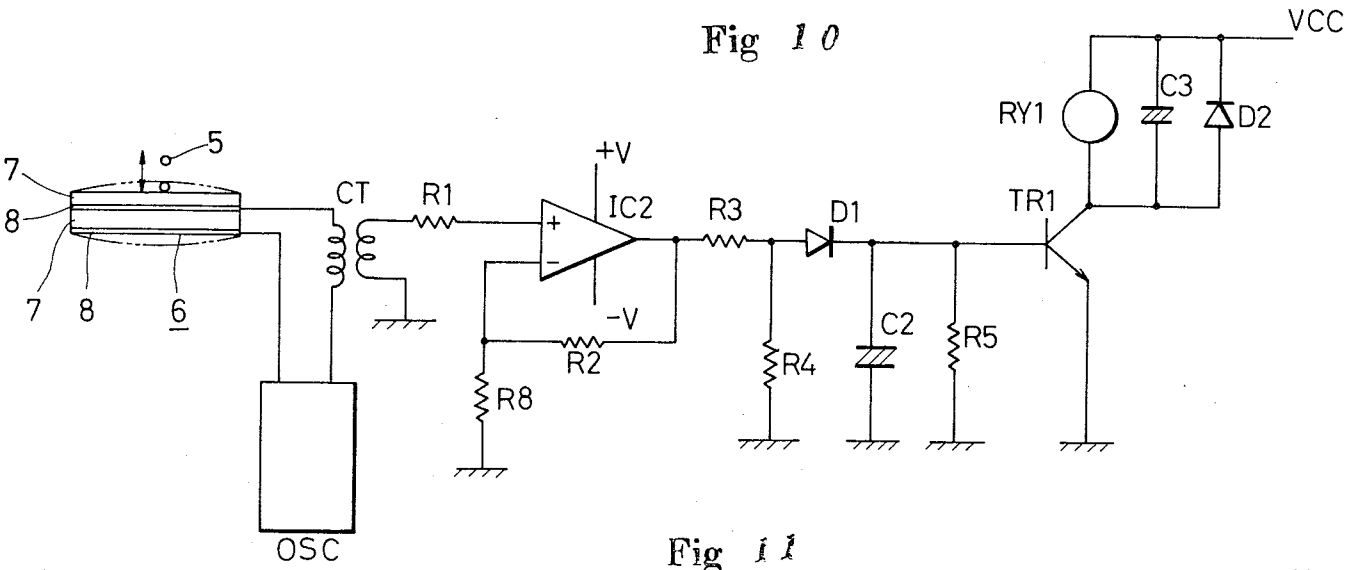
FIG. 10 is a schematic diagram of the electrical circuit of the seventh embodiment according to the present invention.

FIG. 10 illustrates a seventh embodiment of the invention, in which the arrangement and operation of the invention are substantially the same as those of the fifth embodiment except an integrated circuit IC2 is provided, employing as a voltage comparator a broad-band amplifier with AGC terminal, model MC-1590G, manufactured by Motorora Inc., U.S.A., in place of integrated circuit IC1 as used in the fifth embodiment.

Figure 11:
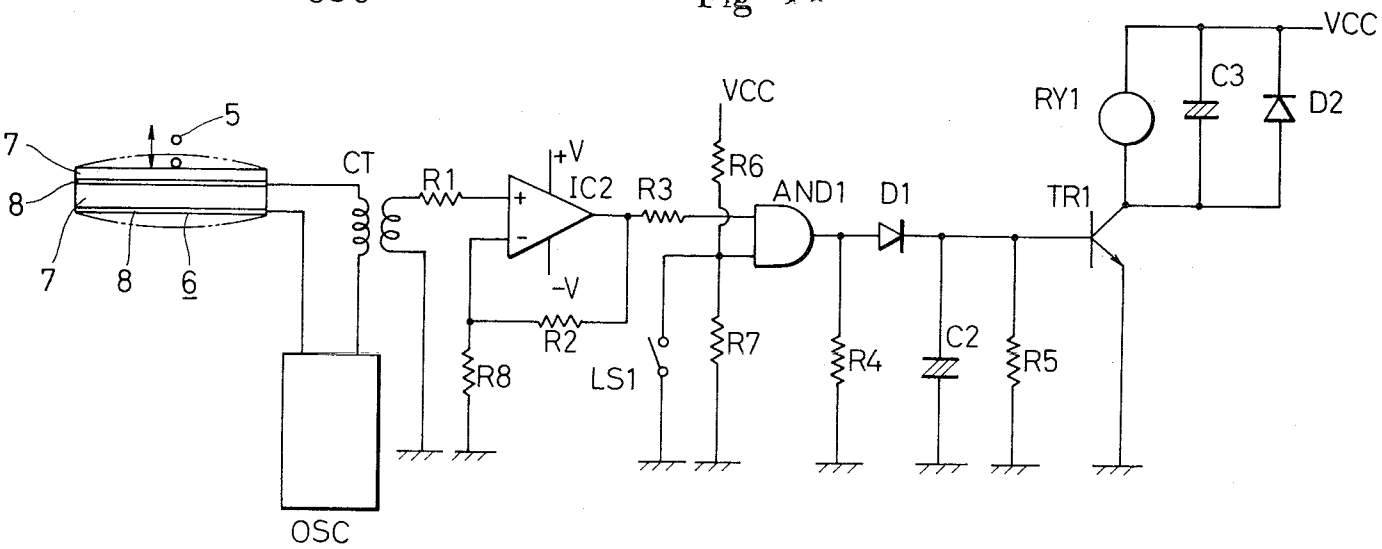
FIG. 11 is a schematic diagram of the electrical circuit of the eighth embodiment according to the present invention.

FIG. 11 illustrates a eighth embodiment of the invention, in which the arrangement and operation of the invention are substantially the same as those of the sixth embodiment except a timing circuit including an AND circuit AND1, resistances R6 and R7, and a limit switch LS1 are added to the seventh embodiment.

Figure 12:
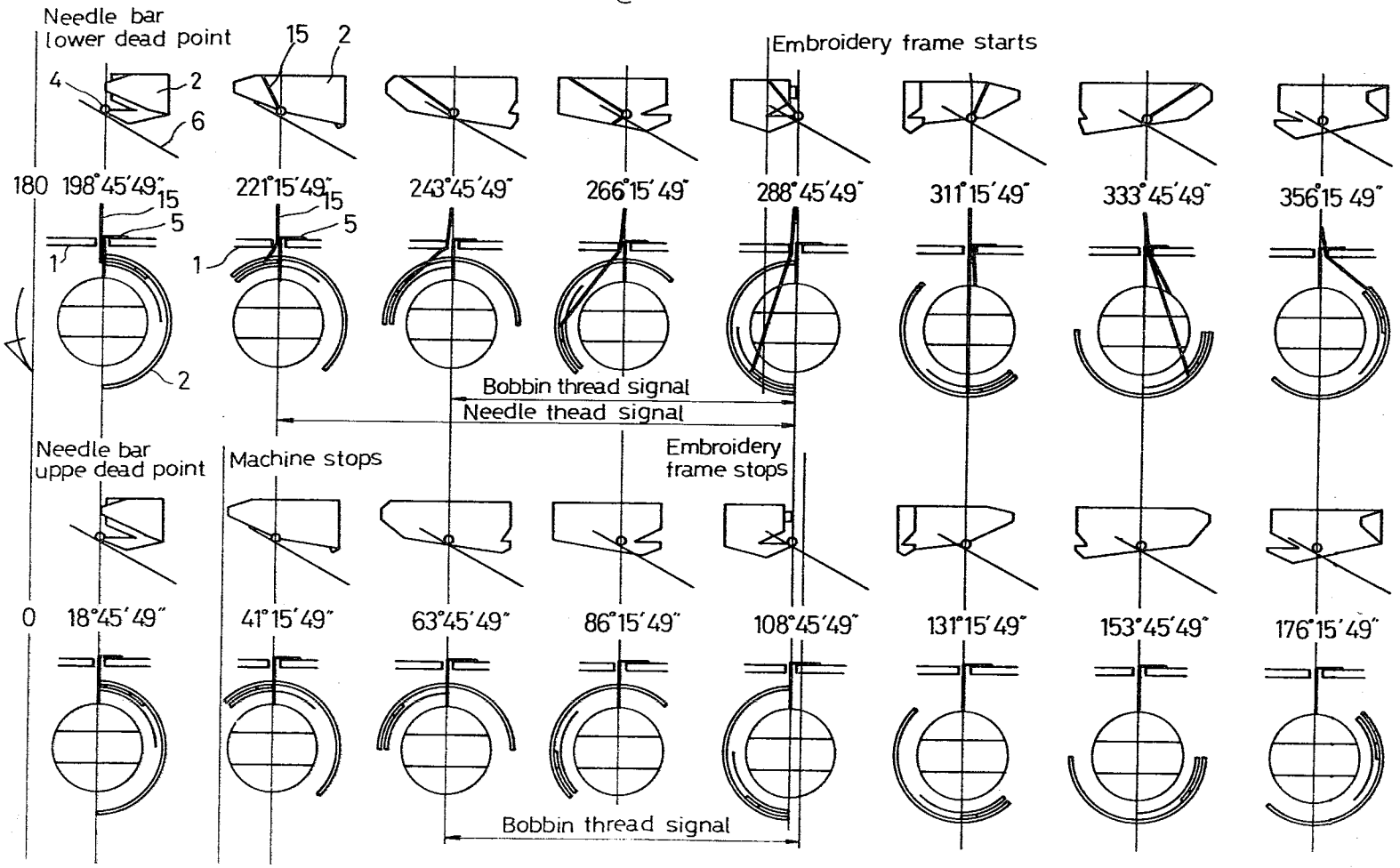
FIG. 12 is an operational view of the ninth embodiment according to the present invention.
Figure 13:
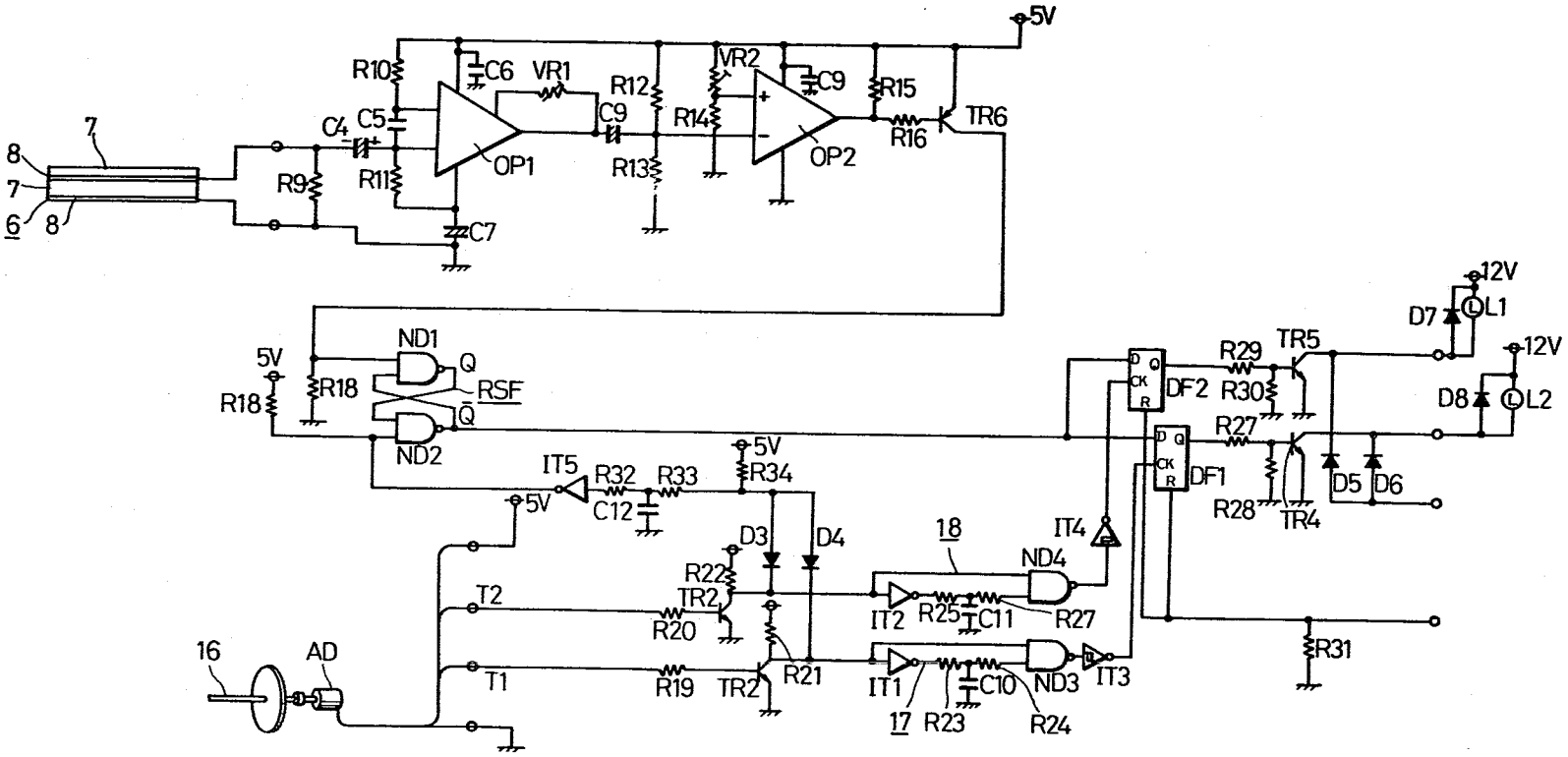
FIG. 13 is a schematic diagram of the electrical circuit thereof.
Figure 14:
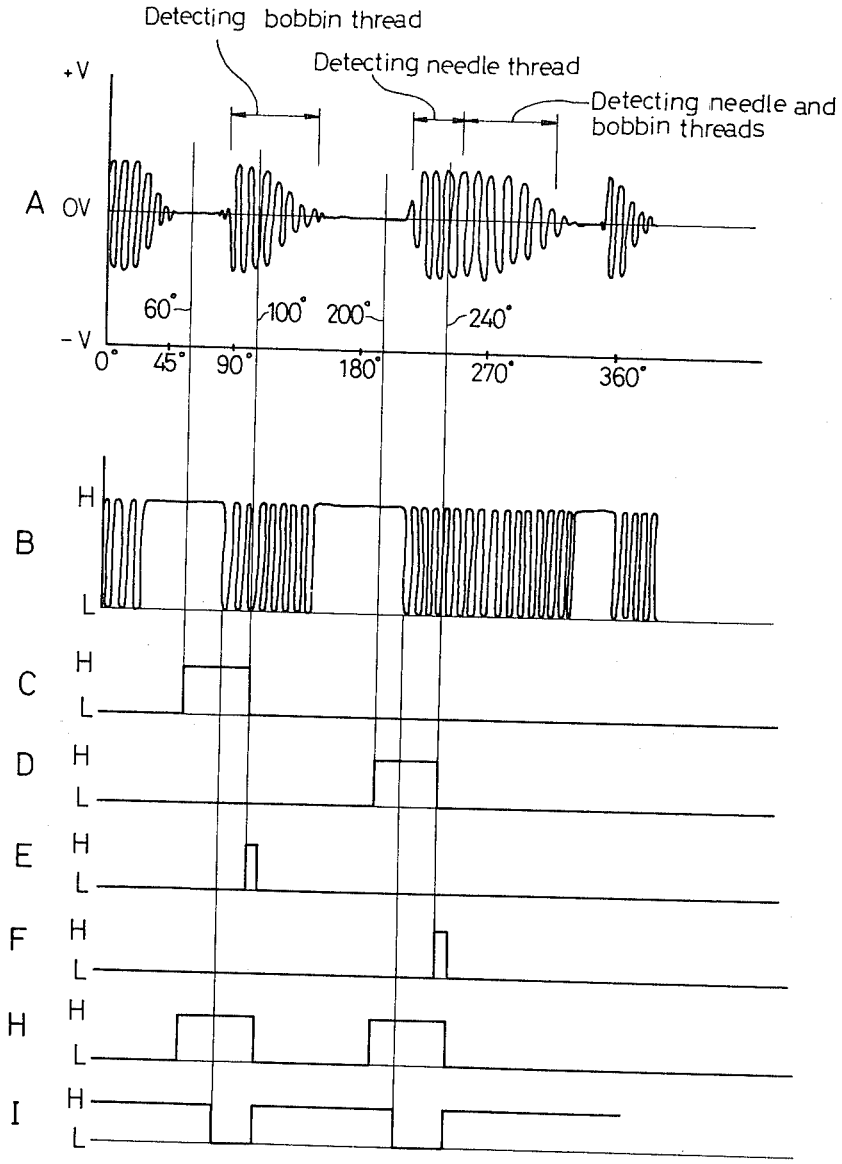
FIG. 14 is a timing diagram thereof.

Referring now to FIGS. 12 through 14, there is shown a ninth embodiment of the invention wherein a breakage of a needle thread 15 or a bobbin thread 5 is detected independently of each other by means of a piezoelectric element 6.

As may be seen in FIG. 12, each time the rotary hook 2 makes two rotations in association with one cyclic motion of the needle bar, the bobbin thread 5 shifts, as shown by the long and two short dashes line in FIG. 3, and contacts the piezoelectric element 6, as long as the rotational angle of the needle bar driving shaft is situated between 63°45′49″ and 108°45′49″. By the same token, the needle thread 15 contacts the element 6 when the rotational angle is situated between 221°15′49″ and 243°45′49″, and both needle thread 15 and bobbin thread 5 contact the element 6 when the rotational angle is situated between 243°45′49″ and 288°45′49″.

Referring now to FIG. 13 which illustrates an electrical circuit according to this embodiment, there are shown a pre-amplifier OP1, a comparator OP2, a rotational-angle sensor AD which, for example, using a rotary encoder, produces a high output at terminals T1 and T2 when the rotational angle of the spindle 16 of the sewing machine is situated, respectively, between 63°45'49" and 108°45'49", and between 221°15'49" and 243°45'49", as shown in FIG. 12. There are further shown a needle thread breakage indicator lamp L1, a bobbin thread breakage indicator lamp L2, a RS-type flip-flop RSF. D-type flip-flops DF1 and DF2, NAND circuits ND1 to ND4, inverters IT1 and IT5, diodes D3 to D8, transistors TR2 to TR6, resistances R9 to R34, variable resistances VR1 and VR2, and capacitors C4 to C12. It will be noted that, in the description hereinafter, each of the circuit elements may sometimes be referred to only by numerals for the purpose of convenience.

As may be seen from the electrical circuit shown in FIG. 13, when the power supply is turned on to thereby start the sewing machine, the rotary hook 2 completes two rotations while the needle bar accomplishes each vertical cyclic motion, that is, each rotation of the mainshaft 16 of the sewing machine. As long as both needle thread 15 and bobbin thread 5 are not broken, the piezoelectric element 6 generates a high output, as shown in FIG. 14, A, in the ranges of angle the mainshaft 16 makes in one rotation, namely: from about 350° to 30° where the needle thread 15 is withdrawn from the rotary hook 2; from 63°45'49" to 108°45'49" where the bobbin thread 5 contacts the piezoelectric element 6, which is virtually from 90° to 120° due to delay caused by the rotation of the mainshaft 16; from 221°15'49" to 243°45'49" where the needle thread 15 contacts the piezoelectric element 6, which is virtually from 225° to 255° due to the same delay as explained above; and from 243°45'49" to 288°45'49" where both needle thread 15 and bobbin thread 5 contact the piezoelectric element 6, which is virtually from 225° to 320° due to the same delay as explained above.

These high outputs are in fact vibratory outputs because the contact of the threads 15 and 5 with the piezoelectric element 6 is vibratory. The high output is fed to comparator OP2, to which is connected in invert buffer TR5 which in turn produces an output as shown in FIG. 14, B.

On the other hand, from terminal T1 of rotational-angle detector AD, a high output corresponding to the frequent contact of the bobbin thread 5 is produced between 60° and 100° of the rotation of the mainshaft 16, as shown in FIG. 14, C. Similarly, from terminal T2, a high output corresponding to the frequency contact of the needle thread 15 is produced between 200° and 240° of the rotation of the mainshaft 16, as shown in FIG. 14, D.

In response to the outputs discussed above, a timing pulse is produced, as shown in FIG. 14, E, from IT3 of the derivative pulse generating circuit 17 via transistor TR2 every time the output of terminal T1 falls, and another timing pulse is produced, as shown in FIG. 14, F, from IT4 of the derivative pulse generating circuit 18 via transistor TR3 every time the output of terminal T2 falls. Each of the timing pulses are fed to the respective CK terminal of DF1 and DF2.

Accordingly, as may be seen from FIG. 14, H and I, when both needle thread 15 and bobbin thread 5 are not broken, the reset terminal of RSF goes low and the Q output of RSF goes low as long as the rotational angle of the mainshaft 16 is 0° to 60° and both terminals T1 and T2 are low. When the angle is 60° to 100° and the output of terminal T1 is high, the reset input of RSF goes high and, as a result, the output from comparator OP2 coupled with the signal of the bobbin thread 5 goes low. Under the situation, the Q output of RSF is inverted to a low. As long as the Q output of RSF is low, the output at terminal T1 goes low, to thereby produce a timing pulse from IT3 of the derivative pulse generating circuit 17 and feed a low input to the reset terminal of RSF. At the point when the timing pulse rises, the low input of RSF reset is fed a little late due to the damping time constant. As a result, at the point where D input of DF1 is low, the CK input of DF1 rises and the Q output of DF1 is held low, to thereby inhibit the bobbin thread breakage indicator L2 from being illuminated and produce no output for the external load, thereby interrupting the machine operation.

Similarly, when the rotational angle of the mainshaft 16 is between 200° and 240°, a timing pulse as shown in FIG. 14, F is fed to CK terminal of DF2 as long as the Q output of RSF is low. The Q output of DF2 is held low in the same manner as explained above, to thereby hold the needle thread breakage indicator lamp L1 inoperative and produce no output for the external load, thereby interrupting the machine operation.

Furthermore, when the rotational angle of the mainshaft 16 is between 240° and 320°, and between 350° and 30°, a low output is also produced from comparator OP2. At this stage, each Q output of DF1 and DF2 is held low, since no timing output is produced from rotational-angle detector AD and the reset input of RSF still remains low, and no pulse is produced for CK terminal of DF1 and DF2.

Under the condition where the thread is not broken, the Q output of RSF is inverted from high to low, since the low output generated from comparator OP2 in cooperation with the detected signal of the thread is fed to the set terminal of RSF as long as the RSF reset input is held high by the timing output generated from the rotational-angle detector AD. On the other hand, if at least either the needle thread 15 or the bobbin thread 5 should break, the Q output is RSF is held high, since the output of comparator OP2 remains high as long as the RSF reset input is held high by the timing output generated from the rotational-angle detector AD associated with the detected signal of each thread.

Accordingly, when a breakage of the thread takes place, a timing pulse is generated, as shown in FIG. 14, E and F, so long as the Q output is RSF is held high. In the event there is a breakage of the needle thread 15 and the bobbin thread 5, the Q output at DF2 and DF1, respectively, will be inverted. Thus, each of the lamp L1 and L2 will illuminate in response to the signal notifying the thread breakage, and a resultant signal will be produced for the external circuit to interrupt the operation of the sewing machine.

Although the invention has been described with reference to several embodiments thereof, it is to be understood that further modifications and variations may be made. For example, as to the piezoelectric element 6 according to the embodiment, a plural number of the elements connected in series may be employed as desired, instead of two elements connected in parallel as shown in FIGS. 4 and 8 and one element as shown in FIGS. 5 through 7 and 9 through 11. Also, the bobbin thread detecting relay RY1 may be energized instead of being deenergized when the bobbin thread is broken. Further, in each of the circuits, any element and any electrical contact type may be used as desired other than those illustrated in the Figures.

What is claimed is:

1. A device for detecting absence of a needle thread or a bobbin thread in a sewing machine having a throat plate including a needle hole provided therein, a rotary hook and a rotary hook fin fitted on said rotary hook, said device comprising at least one piezoelectric element provided between said throat plate and said rotary hook and adapted for intermittent contact with one of said threads when said thread shifts from the center of said needle hole by engaging with said rotary hook fin, said thread passing vertically through said center of said needle hole.

2. A device for detecting absence of a needle thread or a bobbin in a sewing machine having a throat plate including a needle hole provided therein, a rotary hook and a rotary hook fin fitted on said rotary hook, said device comprising at least one piezoelectric element provided between said throat plate and said rotary hook and adapted for intermittent contact with one of said threads when said thread shifts from the center of said needle hole by engaging with said rotary hook fin, said thread passing vertically through said center of said needle hole; an oscillator which oscillates said element and a sensor which detects the change in impedance of said element due to the frequency change in said element caused by its contact with said thread.

3. The invention as defined in claim 2 wherein said sensor is a transformer disposed between said oscillator and said element and adapted for detecting the current change due to the impedance change of said element.

4. A device for detecting absence of a needle thread or a bobbin thread in a sewing machine having a throat plate including a needle hole provided therein, a rotary hook and a rotary hook fin fitted on said rotary hook, said device comprising at least one piezoelectric element provided between said throat plate and said rotary hook and adapted for intermittent contact with one of said threads when said thread shifts from the center of said needle hole by engaging with said rotary hook fin, said thread passing vertically through said center of said needle hole, and a relay circuit for running or stopping said sewing machine according to the output signal from said element.

5. A device for detecting absence of a needle thread or a bobbin thread in a sewing machine having a throat plate including a needle hole provided therein, a rotary hook and a rotary hook fin fitted on said rotary hook, said device comprising at least one piezoelectric element provided between said throat plate and said rotary hook and adapted for intermittent contact with one of said threads when said thread shifts from the center of said needle hole by engaging with said rotary hook fin, said thread passing vertically through said center of said needle hole; an oscillator which oscillates said element; a transformer disposed between said oscillator and said element and adapted for detecting the current change due to the impedance change of said element, and a relay circuit for running and stopping said sewing machine according to the output signal from said transformer.

6. A device for detecting absence of a needle thread or a bobbin thread in a sewing machine having a vertical needle bar which moves cyclically upward and downward along its axis, a throat plate including a needle hole provided therein, a rotary hook and a rotary hook fin fitted on said rotary hook, said device comprising at least one piezoelectric element provided between said throat plate and said rotary hook and adapted for intermittent contact with one of said threads when said thread shifts from the center of said needle hole by engaging with said rotary hook fin, said thread passing vertically through said center of said needle hole; a timing circuit which generates a signal at only the contacting period of said element and one of said threads during one cyclic motion of said needle bar, and a relay circuit which is energized by an AND signal due to the signal of said element and the signal of said timing circuit.

7. A device for detecting absence of a needle thread or a bobbin thread in a sewing machine having a vertical needle bar which moves cyclically upward and downward along its axis, a throat plate including a needle hole provided therein, a rotary hook and a rotary hook fin fitted on said rotary hook, said device comprising at least one piezoelectric element provided between said throat plate and said rotary hook and adapted for intermittent contact with one of said threads when said thread shifts from the center of said needle hole by engaging with said rotary hook fin, said thread passing vertically through said center of said needle hole; an oscillator which oscillates said element; a transformer disposed between said oscillator and said element and adapted for detecting the current change of said element; a timing circuit which generates a signal at only the contacting period of said element and one of said threads during one cyclic motion of said needle bar and a relay circuit which is energized by an AND signal due to the signal of said transformer and the signal of said timing circuit.

* * * * *